United States Patent [19]

Matsuda

[11] Patent Number: 4,952,803

[45] Date of Patent: Aug. 28, 1990

[54] MASS SPECTROMETRY/MASS SPECTROMETRY INSTRUMENT HAVING A DOUBLE FOCUSING MASS ANALYZER

[75] Inventor: Hisashi Matsuda, Hyogo, Japan

[73] Assignee: Jeol Ltd., Tokyo, Japan

[21] Appl. No.: 449,438

[22] Filed: Dec. 11, 1989

Related U.S. Application Data

[63] Continuation of Ser. No. 313,486, Feb. 22, 1989, abandoned.

[30] Foreign Application Priority Data

Feb. 23, 1988 [JP] Japan ..... 63-40195

[51] Int. Cl.[5] ..... H01J 49/32

[52] U.S. Cl. ..... 250/296; 250/297

[58] Field of Search ..... 250/281, 282, 294, 295, 250/296, 297, 397

[56] References Cited

U.S. PATENT DOCUMENTS

| | | | |
|---|---|---|---|
| 3,916,188 | 10/1975 | Devienne | 250/283 |
| 3,944,827 | 3/1976 | Matsuda | 250/299 |
| 4,171,482 | 10/1979 | Vastel | 250/296 |
| 4,435,642 | 3/1984 | Neugebauer et al. | 250/296 |
| 4,472,631 | 9/1984 | Enke et al. | 250/281 |
| 4,553,029 | 11/1985 | Matsuda | 250/296 |

FOREIGN PATENT DOCUMENTS

| | | | |
|---|---|---|---|
| 0043773 | 3/1980 | Japan | 250/296 |

OTHER PUBLICATIONS

F. M. McLafferty, *Tandem Mass Spectrometry,* pp. 239–286 (John Wiley, & Son).

*Primary Examiner*—Bruce C. Anderson

*Attorney, Agent, or Firm*—Fitzpatrick, Cella, Harper & Scinto

[57] ABSTRACT

A double focusing mass spectrometer is used as the second mass analyzer of a Mass Spectrometry/Mass Spectrometry Instrument comprising a uniform electric field and a magnetic sector. Fragment ions produced from precursor ions of a certain ionic species are introduced into a uniform electric field. The fragment ions travel along parabolic orbits and are separated according to their respective energy levels. The separated fragment ions are introduced into a magnetic sector and are dispersed according to their mass by the magnetic sector. A two-dimensional ion detector is disposed along a focal plane of the magnetic sector in order to simultaneously detect the fragment ions and to obtain a spectrum of the fragment ions.

8 Claims, 4 Drawing Sheets

4
5
6
7
$E_0$
$\theta_0$ (55°)
$\varepsilon_1$ (35°)
$\phi_m$ (100°)
$\varepsilon_2$ (24°)
$r_m$
$\ell_{m2}$ 4
5
6
7
$E_0$
$E_0$
$\theta_0$ (50°)
$\varepsilon_1$ (40°)
$\phi_m$ (130°)
$\varepsilon_2$ (31°)
$r_m$
$\ell_{m2}$

MASS SPECTROMETRY/MASS SPECTROMETRY INSTRUMENT HAVING A DOUBLE FOCUSING MASS ANALYZER

This application is a continuation of application Ser. No. 07/313,486 filed Feb. 22, 1989, abandoned.

BACKGROUND OF THE INVENTION

1. Field Of Invention

The present invention relates to an instrument used in mass spectrometry/mass spectrometry (MS/MS). More specifically, it relates to a MS/MS instrument utilizing a double focusing mass analyzer as the second mass analyzer, the analyzer having a uniform electric field and a magnetic sector.

2. Related Background Art

MS/MS is a powerful technique to achieve structural characterization of complex organic compounds. In the MS/MS method, two mass analyzers are arranged in tandem with a chamber for collision induced dissociation inserted therebetween. Precursor ions, sometimes known as parent ions, selected by the first mass analyzer dissociate into fragment ions in the chamber and the resulting fragment ions, sometimes known as daughter ions, are analyzed by the second mass analyzer.

When precursor ions dissociate into fragment ions, it is thought that all of the fragment ions travel at the same velocity as the precursor ions. For this reason, the energies of the fragment ions lie in a wide range from the energy of the precursor to zero, corresponding to their masses.

Heretofore, various mass analyzers, such as a quadrupole analyzer, electric sector, magnetic sector, etc. have been used as the second mass analyzer of the MS/MS instrument. However, to obtain mass spectra of fragment ions with high resolution, it is required to use a double focusing mass analyzer as the second mass analyzer. When a conventional Neir-Johnson type double focusing mass analyzer having an electric sector (E) and a magnetic sector (B) is used as the second mass analyzer, the magnetic sector is scanned to obtain a fragment-ion spectrum. In such scanning-type mass analyzers, at every instant, a small part of the fragment ions can pass through both sectors and impinge on an ion detector, the greatest part of the fragment ions being lost. This leads to a deterioration in the sensitivity. Hence, there is a limit to enhancement of the sensitivity. Furthermore, since energies of fragment ions lie within a wide range, a complex scan method, namely a linked scan method, wherein both sectors E and B are varied in an interrelated manner, must be adopted.

To increase sensitivity, a simultaneous ion detection technique is advantageous as proposed by J.S. Cottrell and S. Evans (Analytical Chemistry, 59 (1987) 1990). However, a conventional Mattaugh-Herzog type double focusing mass analyzer for simultaneous detection is not capable of simultaneous detection over a wide mass range, because only fragment ions having energies lying within about 5% of the energy of precursors ions can pass through the electric sector and only a small part of fragment ion spectrum can be obtained at one measurement.

SUMMARY OF THE INVENTION

It is an object of the invention to provide a MS/MS instrument which can improve sensitivity by simultaneous detection.

It is another object of the invention to provide a MS/MS instrument which can obtain a fragment ion spectrum which covers a wide mass range without using a linked scan method.

In the MS/MS instrument according to the invention, a uniform electric field is used in combination with a magnetic sector for deflecting and focusing fragment ions, and a two-dimensional ion detector is arranged along a focal plane of fragment ions focused by the magnetic sector.

DESCRIPTION OF THE PREFERRED EMBODIMENTS

Figure 1:
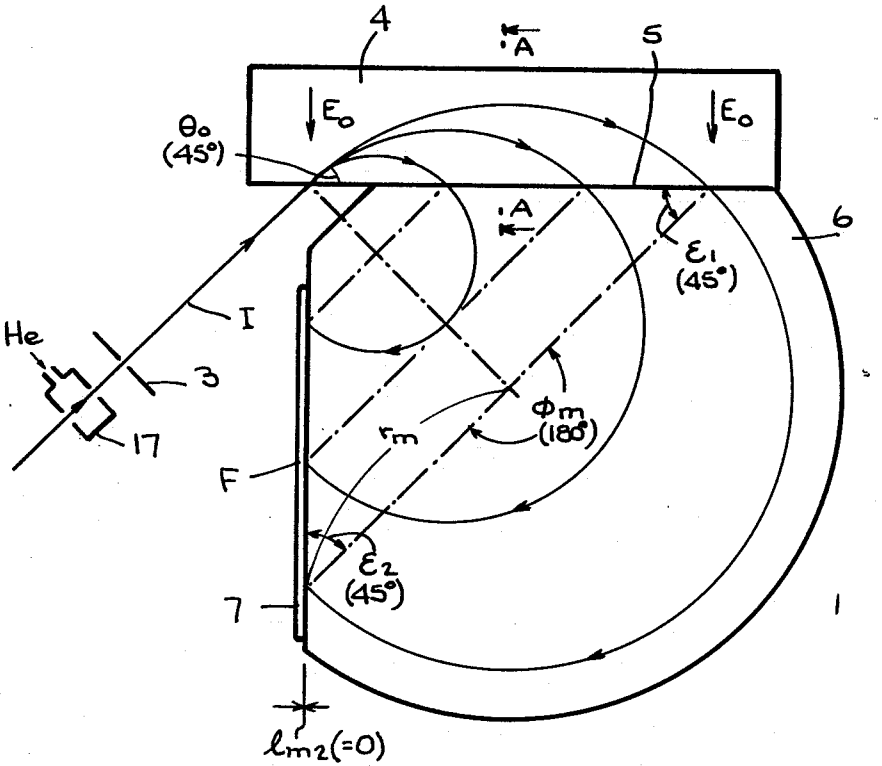
FIG. 1 is a diagram of a double focusing mass analyzer which is used as the second mass analyzer in a MS/MS instrument according to the invention.

Referring to FIG. 1, there is shown a double-focusing mass spectrometer which is used as the second mass analyzer in a MS/MS instrument according to one embodiment of the invention. The spectrometer comprises a collision cell 17 for actively dissociating precursor ions selected by the first mass analyzer (not shown) into fragment ions, a source slit 3, a uniform electric filed 4 into which fragment ions I from the collision cell 17 are introduced, a magnetic sector 6, and a two-dimensional ion detector 7. The ions I enter the uniform electric field 4 at the incident angle $\theta_0$ (=45°) and travel in the electric field 4 along different parabolic orbits according to their energies. As a result, the ions are separated according to their energies and arrive along the exit face 5 of the electric field 4. The ions emerging from the electric field enter into the magnetic sector 6 which is arranged beside the exit face 5 of the electric field 4 and travel at different radii of curvature according to their masses. Then, the ions are focused onto a focal plane F, along which the two-dimensional ion detector 7 is arranged for separately and simultaneously detecting each ion.

Figure 2:
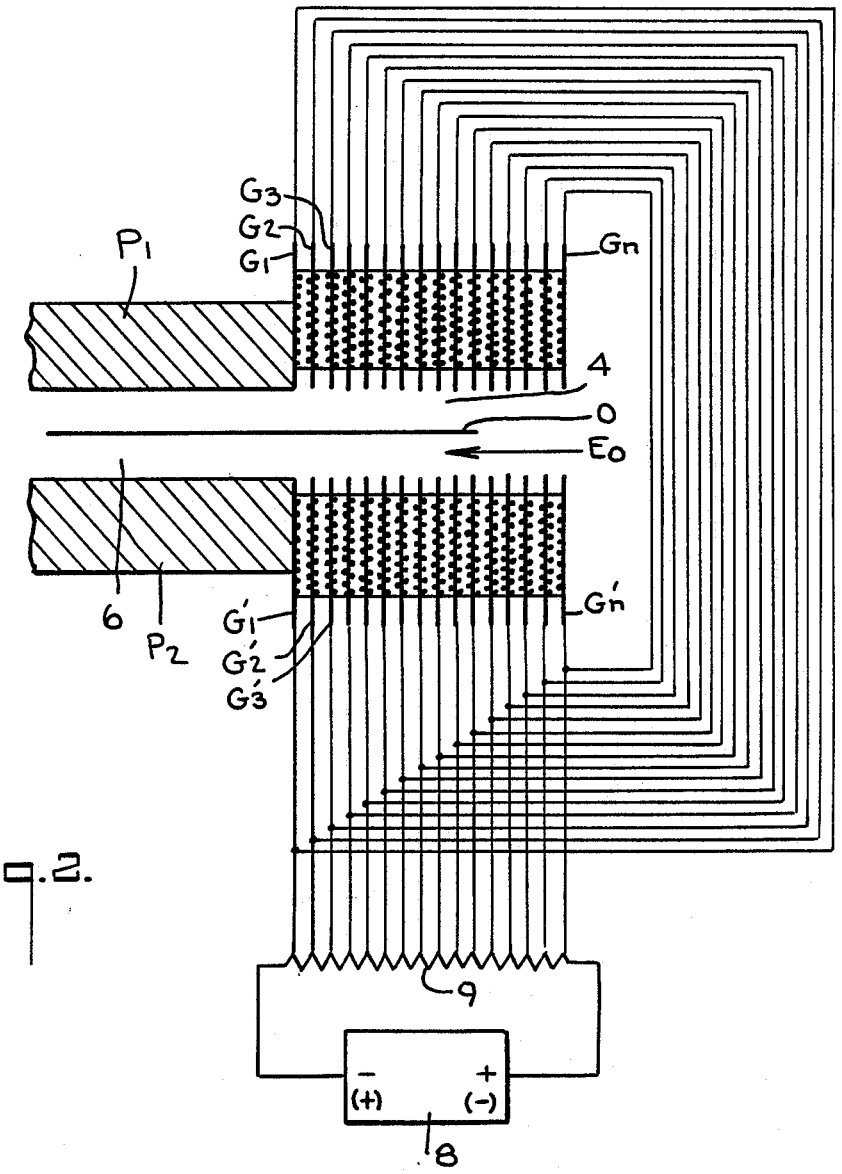
FIG. 2 is a cross-sectional view taken along line A-A of FIG. 1.

FIG. 2 shows a cross-sectional view taken along line A—A of FIG. 1. As shown in FIG. 2, the magnetic sector 6 is formed between a pair of magnetic pole pieces P1 and P2 which are disposed symmetrically with respect to the central ion path O. A plurality of parallel plate electrodes Gl–Gn and Gl'–Gn' are positioned beside the pole pieces P1 and P2 in a symmetrical relation with respect to the path 0. A voltage source 8 and a voltage divider 9 are used to apply an appropriate voltage to each electrode in order that a uniform electric filed $E_0$ is generated between the plate electrodes Gl-Gn and Gl'-Gn'. The polarity of the voltage source is selected in accordance with the polarity of the ions to be analyzed, so that the force exerted on the ions is directed towards the magnetic sector 6.

ION TRAJECTORY IN THE UNIFORM ELECTRIC FIELD

Figure 3:
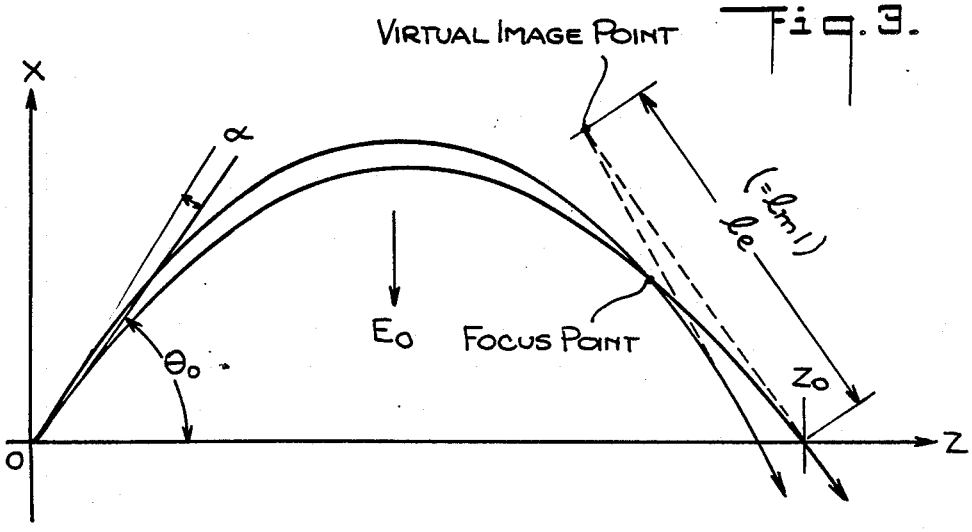
FIG. 3 is a diagram illustrating the ion path in the uniform electric field shown in FIG. 1.

The movement of ions in the uniform electric field is now described in detail. The x-z plane of the Cartesian coordinate system is assumed as shown in FIG. 3. The uniform electric field $E_0$ is applied to the negative direction of the x-axis in the region $x>0$. The electric potential is assumed to be zero on the z-axis and in the region $x<0$. The trajectory of an arbitrary ion having mass m, charge e and velocity v $(=v_0(1+\delta_v))$ is calculated, where $v_0$ is the velocity of a reference ion and $\delta_v$ is a variable which is much smaller than unity.

The equations of motion are given by:

$$m\frac{d^2x}{dt^2} = -eE_0 \tag{1}$$

$$m\frac{d^2z}{dt^2} = 0 \tag{2}$$

It is assumed that the ion is injected at $x=z=0$ with an incident angle $(\theta_0+\alpha)$ with respect to the z-axis, where $\theta_0$ is the incident angle of the reference ion.

Equation (1) is solved with respect to t as follows:

$$x = \left.\frac{dx}{dt}\right|_0 t - \frac{1}{2}\frac{eE_0}{m}t^2 \tag{3}$$

Equation (2) is transformed by integration with respect to t as follows:

$$\frac{dz}{dt} = \text{Constant} \tag{2'}$$

Equation (2') shows that the velocity of the ion in the direction of z is kept constant.

From vector analysis of FIG. 3, it is understood that equation (4) is held with respect to the velocity of the ion in the direction of z as follows:

$$\frac{dz}{dt} = v_0(1+\delta_v)\cos(\theta_0+\alpha) \tag{4}$$

By the first order approximation assuming $a<<1$ and $\delta_v<<1$, equation (4) is transformed as follows:

$$\frac{dz}{dt} = v_0\cos\theta_0(1+\delta_v-\alpha\tan\theta_0) \tag{4'}$$

Equation (4') is transformed by integration with respect to t as follows:

$$t = \frac{z}{v_0\cos\theta_0}(1-\delta_v+\alpha\tan\theta_0) \tag{5}$$

Substituting equation (5) into equation (3) and using the following relationship:

$$\left.\frac{dx}{dt}\right|_0 = v_0(1+\delta_v)\sin(\theta_0+\alpha) = v_0\sin\theta_0(1+\delta_v+\alpha\cot\theta_0) \tag{6}$$

equation (7) is obtained.

$$X = z\tan\theta_0\left(1+\frac{\alpha}{\sin\theta_0\cos\theta_0}\right) - \frac{z^2}{z^0}\tan\theta_0(1-2\delta_v+2\alpha\tan\theta_0) \tag{7}$$

Where, $z_0$ is the value of the z-coordinate where the reference ion $(\alpha=\delta_v=0)$ intersects the z-axis again, and is given by the following equation:

$$z_0 = \frac{2mv_0^2\sin\theta_0\cos\theta_0}{eE_0} \tag{8}$$

Now, it is assumed that the arbitrary ion intersects the z-axis again at $z=z_0+\Delta z$. Then, the following equation is obtained from equation (7).

$$\frac{\Delta z}{z_0} = 2\delta_v + \alpha(\cot\theta_0 - \tan\theta_0) \tag{9}$$

For the well known case of $\theta_0=45°$, $\Delta z/z_0$ is independent of $\alpha$. This means that the ion beam is focused on the z-axis and the velocity dispersion at the focus point is given by $2z_0\delta_v$.

For the general case of $\theta_0 45°$, the focus point is obtained by setting the coefficient of $\alpha$ in equation (7) to zero. Then the coordinates of the focus point are given as follow:

$$\frac{x}{z_0} = \frac{1}{2\sin\theta_0\cos\theta_0}\left(1-\frac{1}{2\sin^2\theta_0}\right) \tag{10}$$

$$\frac{z}{z_0} = \frac{1}{2\sin^2\theta_0} \tag{10'}$$

If $\theta_0 45°$, the focus point is in the region $x>0$, and the ion beam diverges again after the focus point. Therefore, in the field free region $x<0$, ions move as if they started from a virtual image point in free space. The position of the virtual image point is calculated from the value of dx/dz at $x=0$ as follows:

$$\left.\frac{dx}{dt}\right|_0 = -\tan\theta_0 - \frac{\alpha}{\cos^2\theta_0} \tag{11}$$

It should be noted that equation (11) is independent of $\delta_7$.

From equations (11) and (9), the distance $l_e$ between the virtual image point and the point $z=z_0$ is calculated as follows:

$$l_e = z_0(\tan\theta_0 - \cot\theta_0)\sin\theta_0 \tag{12}$$

The velocity dispersion D: at the virtual image point (perpendicular to the beam direction) is given from equations (9) and (11) as follows:

$$D_{67} = 2z_0\sin\theta_0 \tag{13}$$

DOUBLE FOCUSING CONDITION

A double focusing mass spectrometer can be realized if a magnetic sector field coincides to the uniform electric field. The conditions for double focusing are that the virtual image point coincides with the source point of the magnetic sector and that the velocity dispersion $D_{\delta m}$ of the magnetic sector, when ions have travelled in reverse through the magnetic field, is equal to $D_{67}$ given in equation (13).

The velocity dispersion $D_{\delta m}$ of magnetic sector for reverse ray is given by the following equation:

$$D_{\delta m}=r_m(1-\cos\phi_m)+l_{m1}\{\sin\phi_m+(1-\cos\phi_m)\tan\epsilon_1\} \quad (14)$$

Where $r_m$, $\phi_m$, $\epsilon_1$ and $l_{m1}$ are given as follows:

$r_m$ : the radius of the central beam ions in the magnetic sector;

$\phi_m$ : the angle of deflection of ions caused by the magnetic sector; $\epsilon_1$ : the incident angle of ions to the magnetic sector;

$l_{m1}$ : the distance between the source point of the magnetic sector and the entrance of the magnetic sector.

The values of $l_e$ and $D_\delta$ for various $\theta_0$ are given in Table 1.

TABLE 1

| $\theta_0$ | $l_e/Z_0$ | $D\delta/Z_0$ |
|---|---|---|
| 45° | 0 | 1.4142 |
| 50° | 0.2701 | 1.5321 |
| 55° | 0.5963 | 1.6383 |
| 60° | 1 | 1.7321 |

To summarize, double focusing conditions are given by the following equations;

$$l_e=l_{m1} \quad (15)$$

$$D_\delta=D_{\delta m} \quad (16)$$

Accordingly, double focusing ion optical systems can be realized by selecting parameters or dimensions of the uniform electric field and the magnetic sector in order that both equations (15) and (16) are satisfied.

EXAMPLES OF DOUBLE FOCUSING MASS SPECTROMETERS ACCORDING TO THE INVENTION

Table 2 given below provides four examples of the mass spectrometer, in which ion optical parameters are properly selected in order that the double focusing conditions are satisfied. In Table 2, the parameters and the calculated values of the coefficients which represent the characteristics of the ion optical systems are listed.

TABLE 2

| | A | B | C | D |
|---|---|---|---|---|
| $\theta_0$ | 45° | 45° | 50° | 55° |
| $\phi_m$ | 180° | 135° | 130° | 100° |
| $\epsilon_1$ | 45° | 45° | 40° | 35° |
| $\epsilon_2$ | 45° | 16° | 31° | 24° |
| $r_m/Z_0$ | 0.707 | 0.828 | 0.580 | 0.478 |
| $l_{m1}/Z_0$ | 0 | 0 | 0.270 | 0.596 |
| $l_{m2}/Z_0$ | 0 | 1.161 | 0.562 | 0.939 |
| $A_x$ | −1 | −1.983 | −1.265 | −1.207 |
| $A_\gamma/r_m$ | 1 | 1.693 | 1.671 | 2.068 |
| $A_y$ | −2.14 | −2.21 | −1.19 | −1.40 |
| $A_\beta/r_m$ | −0.34 | −0.26 | −0.60 | −1.63 |

Where $\epsilon_2$ is the exit angle of ions from the magnetic sector, $l_{m2}$ is the distance between the exit of the magnetic sector and the focal plane of ions, $A_\gamma$ is the mass dispersion, $A_x$ is image magnification, and $A_\gamma$ and $A_{62}$ are first-order aberration coefficients.

The mass spectrometer shown in FIG. 1 corresponds to the example listed in Column A of Table 2. In this embodiment, the focal plane coincides to the exit boundary of the magnetic sector, and the two-dimensional ion detector 7 is arranged along the exit boundary of the magnetic sector.

Figure 4:
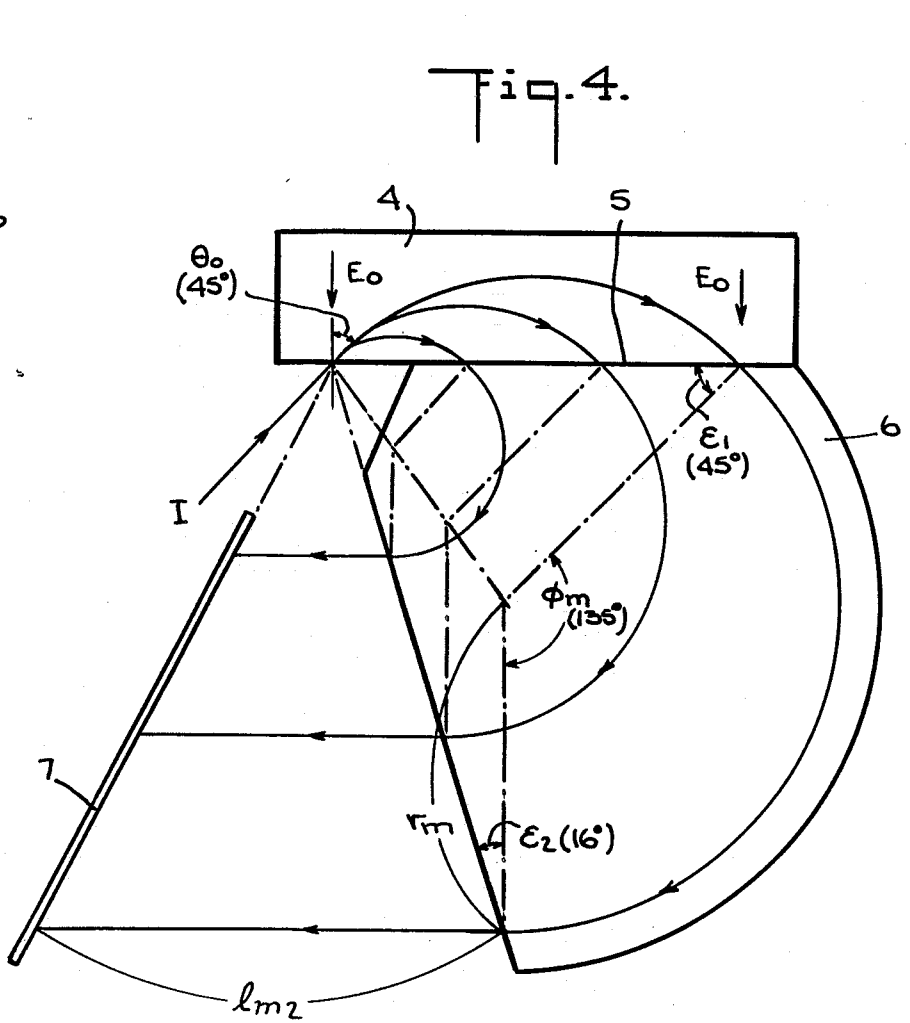
FIG. 4 is a schematic diagram of a double-focusing mass spectrometer according to the invention.
Figure 6:
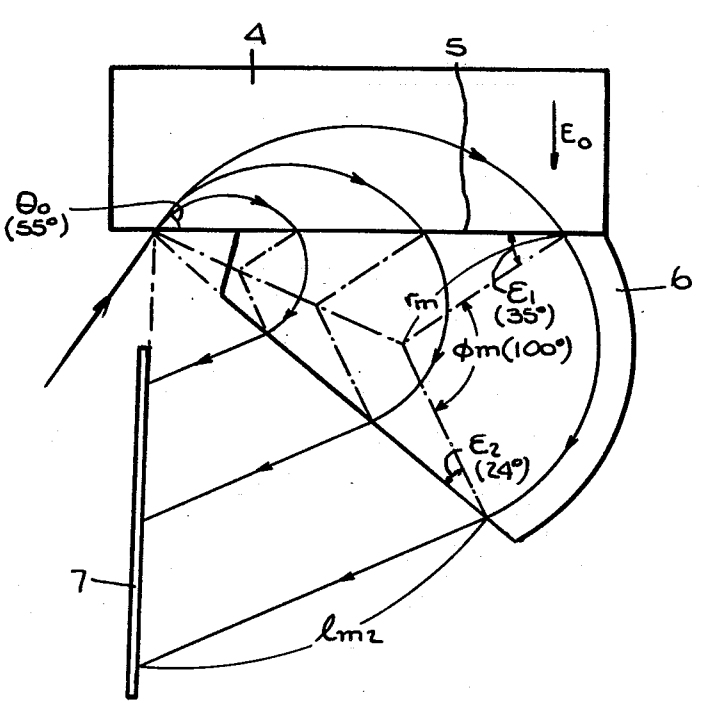
FIG. 6 is a schematic diagram of a double-focusing mass spectrometer according to the invention.
Figure 5:
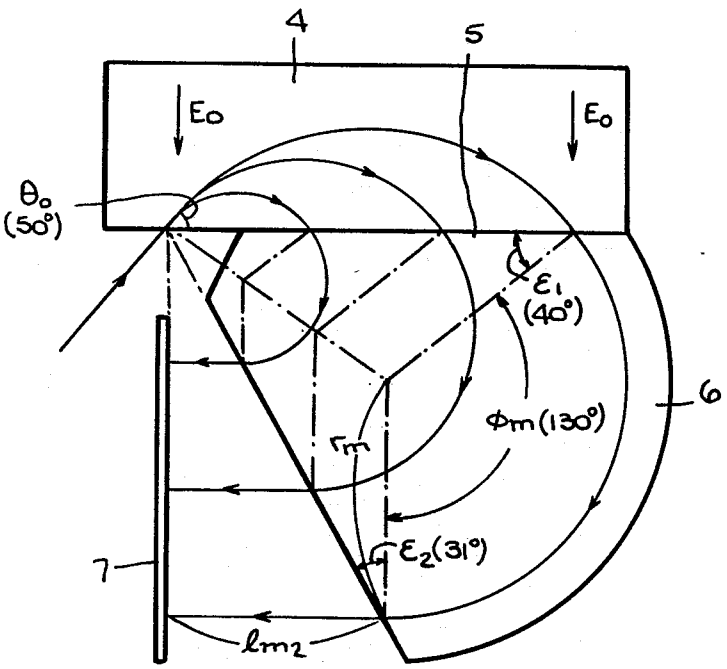
FIG. 5 is a schematic diagram of a double-focusing mass spectrometer according to the invention.

Mass spectrometers shown in FIGS. 4, 5 and 6 correspond to examples listed in columns B, C and D, respectively. If the exit boundary of the magnetic sector is a straight line through the origin of the electric field (injection point) as shown in FIGS. 1, 4, 5 and 6, the focal plane of the magnetic sector for different masses is also a straight line through the origin and the double focusing holds for all masses, because $z_0$ and $r_m$ are proportional to m (compare: $v_0$ is constant) and $\phi_m$, $\epsilon_1$ and $\epsilon_2$ are equal for all masses. The trajectories for different masses are completely similar to each other as shown in FIGS. 1, 4, 5 and 6, where three different trajectories are shown.

The values of the ion optical parameters in Table 2 are suitable for practical use. Each example listed in Table 2 has a large incident angle $\epsilon_1$ to the magnetic sector (35°–45°), and the large incident angle makes it possible to obtain vertical focusing which gives improvement of sensitivity.

RESOLVING POWER AND MASS SCALE

Resolving power of a mass spectrometer is given by the equation $$R=\frac{A\gamma}{A_x s} \quad (17)$$

neglecting aberrations, where s is source slit width.

The image magnification of the virtual image of the uniform electric field is unity because the parallel shift of the coordinate in the z-direction does not change the ion trajectory. Therefore, the resolving power of the mass spectrometer shown in FIGS. 1, 4, 5 and 6 can be calculated using the value of parameters given in Table 2. Assuming $r_m$=300 mm and s=0.1 mm, the estimated resolving powers are A:3,000, B:2,500, C:3,900 and D:5,100.

The resolving power is proportional to $r_m$ (or m) for a fixed width of the source slit. This means that if the resolving power at m=1,000 is 2,000, then at m=100 the resolving power is 200. This value is enough for ordinary mass analysis.

Since $z_0$ and $r_m$ are proportional to m, the mass scale on a focal plane is proportional to the distance from the origin as can be seen from FIGS. 1, 4, 5 and 6. Therefore, the mass scale on the focal plane is exactly linear. This result is especially advantageous for precise mass calibration.

MS/MS INSTRUMENT

Figure 7:
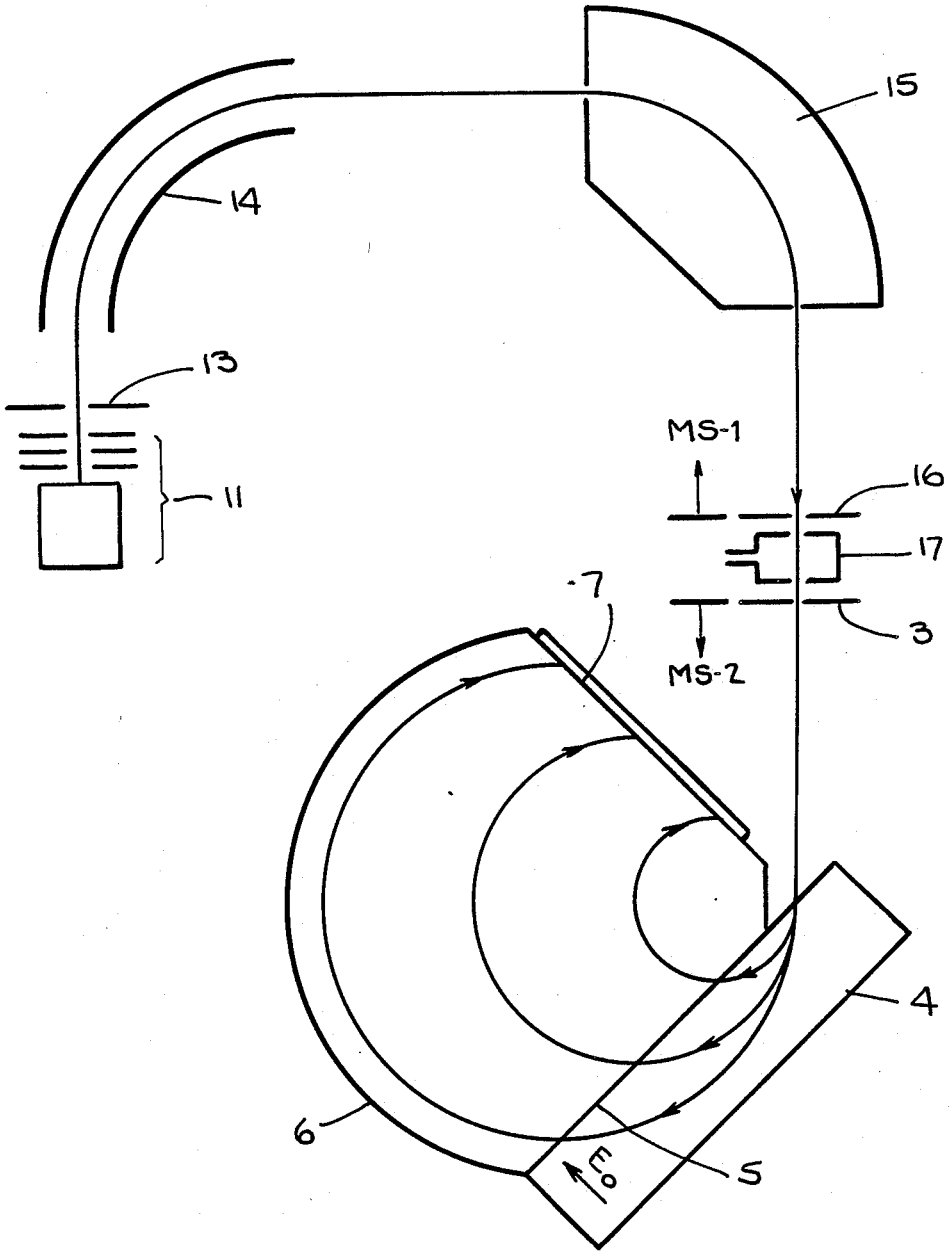
FIG. 7 is a diagram of a total ion optical system of a MS/MS instrument according to the invention.

FIG. 7 shows the total ion optical system of a MS/MS instrument in accordance with the invention. The MS/MS instrument includes a first mass analyzer MS-1 consisting of a conventional scanning-type double focusing mass spectrometer which comprises an ion source 11, a source slit 13, a cylindrical electric field 14, a magnetic sector 15 and a collector slit 16. A collision cell 17 is located behind MS-1. A second mass analyzer MS-2 consisting of a double focusing ion optical system as shown in FIG. 1 is arranged behind MS-1.

In the operation of the instrument shown in FIG. 7, the precursor ions selected by the first mass-selective device MS-1 enter the collision cell 17 that is disposed behind the collector slit 16. In the cell 17, the precursor ions collide with the collision gas and dissociate into fragment ions. The fragment ions are then introduced into MS-2 and dispersed along the focal plane according to mass, and they are simultaneously detected by a two-dimensional detector 7. As described already, the fragment ions have a wide range of energies or masses and all of them cannot pass through a conventional electric sector field simultaneously. However, since a uniform electric field is used in the instrument shown in FIG. 7, all the fragment ions having a wide range of energies can pass through the electric field simultaneously, enter the magnetic sector, and be dispersed along the focal plane according to their masses. The spectrum of fragment ions obtained by the simultaneous detection covers a wide range of masses with high sensitivity.

In the aforementioned embodiments, a uniform electric field and a magnetic sector are connected without substantial field-free space between them. It is possible, however, to realize ion optical systems according to the invention with field-free space between them. Such systems having field-free space between both fields are advantageous for manufacture.

The terms 'mass spectrometry', 'mass spectrometry/-mass spectrometry', 'mass analyzer', 'uniform electric field' 'magnetic sector', 'precursor ions', 'fragment ions', 'ion detector', 'collision cell', 'magnetic pole piece', 'plate electrodes', 'virtual image point' and other terms identifying features of the disclosed invention are each used generically; that is, the functional requirements that must be met by each of the elements identified by these terms will be apparent to one of ordinary skill in the art, and those terms accordingly are used throughout the specification and the claims to designate any element which meets such requirements.

The present invention is not limited to the details of the foregoing embodiments but includes various modifications within the scope and spirit of the appended claims.

What is claimed is:

1. A double mass spectrometry analysis apparatus comprising:
- an ion source for producing ions;
- a first mass analyzer for selecting precursor ions from the ions produced by said ion source;
- a dissociating apparatus for dissociating the precursor ions;
- a second mass analyzer comprising,
  - a region having a uniform electric field comprising an entrance point and an exit plane, wherein the electric field is perpendicular to said exit plane, wherein the dissociated ions from said dissociating apparatus are injected into said entrance point, wherein the dissociated ions travel along parabolic orbits in said uniform electric field, and wherein the dissociated ions exit said region through said exit plane, the dissociated ions being separated in accordance with their respective energy levels, and
  - a magnetic sector having a mass-dispersive magnetic field applied to the ions exiting from said region; and
- a two-dimensional ion detector on which ions exiting from said magnetic sector impinge, wherein said detector is disposed along a focal plane of ions focused by said magnetic sector.

2. An apparatus according to claim 1, wherein said electric sector and said magnetic sector are connected without a substantial field-free space therebetween.

3. An apparatus according to claim 1, wherein said electric sector and said magnetic sector are connected with a substantial field-free space therebetween.

4. A double focusing mass spectrometer apparatus used as a second mass analyzer of a double mass spectrometer instrument for analyzing ions, said apparatus comprising:
- electric field generation with a region having a uniform electric field comprising an entrance point and an exit plane, wherein the electric field is perpendicular to said exit plane, wherein the ions are injected into said entrance point, wherein the ions travel along parabolic orbits in said region, and wherein the ions exit said region through said exit plane the dissociated ions being separated in accordance with their respective energy levels;
- a magnetic sector having a mass-dispersive magnetic field applied to the ions exiting from said region; and
- a two-dimensional ion detector onto which ions exiting from said magnetic sector impinge, said detector being disposed along a focal plane of ions focused by said magnetic sector.

5. An apparatus according to claim 4, wherein said electric field generator and said magnetic sector are connected without a substantial field-free space therebetween.

6. An apparatus according to claim 4, wherein said electric field generator and said magnetic sector are connected with a substantial field-free space therebetween.

7. A double mass spectrometry analysis apparatus comprising:
- an ion means for producing ions;
- a first mass analyzer means for selecting precursor ions from the ions produced by said ion means;
- dissociating means for dissociating the precursor ions;
- an electric field generating means for generating a uniform electric field comprising an entrance point and an exit plane, wherein the electric field is perpendicular to said exit plane, wherein the dissociated ions from said dissociating means are injected into said entrance point, wherein the dissociated ions travel along parabolic orbits in the uniform electric field, and wherein the dissociated ions exit said electric field generating means through said exit plane, the dissociated ions being separated in accordance with respective energy levels;
- a magnetic field generating means for generating a mass-dispersive magnetic field applied to the ions exiting from said electric field generating means; and
- a two-dimensional ion detector means for obtaining a spectrum of the ions exiting from said magnetic field generating means, wherein said detector means is disposed along a focal plane of ions focused by said magnetic field generating means.

8. A process for analyzing ions comprising the steps of:
- producing the ions;
- selecting precursor ions from the ions produced in said producing step;
- dissociating the precursor ions;

applying a uniform electric field into which dissociated ions are injected, wherein the dissociated ions travel along parabolic orbits in the uniform electric field, and wherein the dissociated ions exit through an exit plane, wherein the electric field is perpendicular to the exit plane and wherein the dissociated ion are separated in accordance with their respective energy levels;

applying a mass-dispersive magnetic field to the ions exiting along the plane of the uniform electric field; and detecting the ions exiting from the mass-dispersive magnetic field, wherein said detecting is along a focal plane of ions focused by the mass-dispersive magnetic field.

* * * * *